US006473573B2

(12) United States Patent
Izumi et al.

(10) Patent No.: US 6,473,573 B2
(45) Date of Patent: Oct. 29, 2002

(54) DEVELOPING APPARATUS WITH TEMPERATURE SENSOR

(75) Inventors: Takao Izumi; Shinji Aoki, both of Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/812,819

(22) Filed: Mar. 21, 2001

(65) Prior Publication Data

US 2002/0136561 A1 Sep. 26, 2002

(51) Int. Cl.[7] ..... G03G 15/08

(52) U.S. Cl. ..... 399/44; 399/53; 399/92; 399/284

(58) Field of Search ..... 399/44, 53, 91, 399/92, 222, 252, 274, 284

(56) References Cited

U.S. PATENT DOCUMENTS 5,278,616 A * 1/1994 Hirano et al. ..... 399/284 X
5,365,318 A * 11/1994 Hiraoka et al. ..... 399/44
5,701,550 A * 12/1997 Lofftus et al. ..... 399/44
6,185,382 B1 * 2/2001 Knott et al. ..... 399/44

* cited by examiner

*Primary Examiner*—William J. Royer
(74) *Attorney, Agent, or Firm*—Foley & Lardner

(57) ABSTRACT

A developing apparatus of the present invention is provided with a developing roller for supplying a developing agent to an image carrier by rotation, a layer regulation blade for regulating the layer thickness of a developing agent supplied to the developing roller, a thermistor for sensing the temperature of either the developing roller or the layer regulation blade, and a control section for controlling the rotation of the developing roller in accordance with a temperature sensed by the thermistor.

28 Claims, 4 Drawing Sheets

DEVELOPING APPARATUS WITH TEMPERATURE SENSOR

BACKGROUND OF THE INVENTION

The present invention relates to a developing apparatus that is used, for example, in an electrophotographic color image forming apparatus.

In recent years, the use of color images has become common in offices, and more and more electrophotographic color image forming apparatuses are commercially available. Color printers and color MFPs, in particular, are in wide use, and they have been improved in printing speed.

Unlike the conventional color copying machines, these types of apparatus are not maintained regularly. In other words, the maintenance by the user is required, and the user replaces the developing unit or toner unit with a new one. A conventional low-speed color image forming apparatus employs a one-component nonmagnetic type color developing unit so as to enable maintenance by the user.

If such a one-component nonmagnetic type color developing unit is applied to a high-speed color printer without any modifications, toner may adhere to a developing roller or a layer regulation blade, resulting in defective images.

This phenomenon holds true for a black-and-white printer or MFP as well. If a high-speed printer apparatus employs a one-component nonmagnetic developing unit, toner may adhere to a developing roller or a layer regulation blade, resulting in defective images.

BRIEF SUMMARY OF THE INVENTION

The present invention has been made in consideration of the above circumstances, and the object of the invention is to provide a developing apparatus which can employ a high-speed one-component nonmagnetic type unit without adhesion of a developing agent to a developing roller and a layer regulation means, and which therefore enables production of images with reliable quality.

A developing apparatus of the present invention comprises: a developing roller for supplying a developing agent to an image carrier by rotation; a layer regulation member for regulating a layer thickness of the developing agent supplied to the developing roller; temperature sensing means for sensing a temperature of either the developing roller or the layer regulation member; and control means for controlling the rotation of the developing roller in accordance with a temperature sensed by the sensing means.

Another developing apparatus of the present invention comprises: a developing roller for supplying a developing agent to an image carrier by rotation; a layer regulation member for regulating a layer thickness of the developing agent supplied to the developing roller; temperature sensing means for sensing a temperature of either the developing roller or the layer regulation member; cooling means for cooling the developing roller by supplying air to the developing roller; and control means for controlling the air supply by the cooling means in accordance with a temperature sensed by the sensing means.

A further developing apparatus of the present invention comprises: first and second developing means which are selectively used and each of which includes a developing roller for supplying a developing agent to an image carrier by rotation, a layer regulation member for regulating a layer thickness of the developing agent supplied to the developing roller, and temperature sensing means for sensing a temperature of either the developing roller or the layer regulation member; and switching means, operating when one of the first and second developing means is in use, for switching the developing means in use to the developing means in accordance with a temperature sensed by the sensing means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description it given above and the detailed description of the preferred embodiments given below, serve to explain the principles of the invention.

DETAILED DESCRIPTION OF THE INVENTION

Embodiments of the present invention will now be described in detail with reference to the accompanying drawings.

Figure 1:
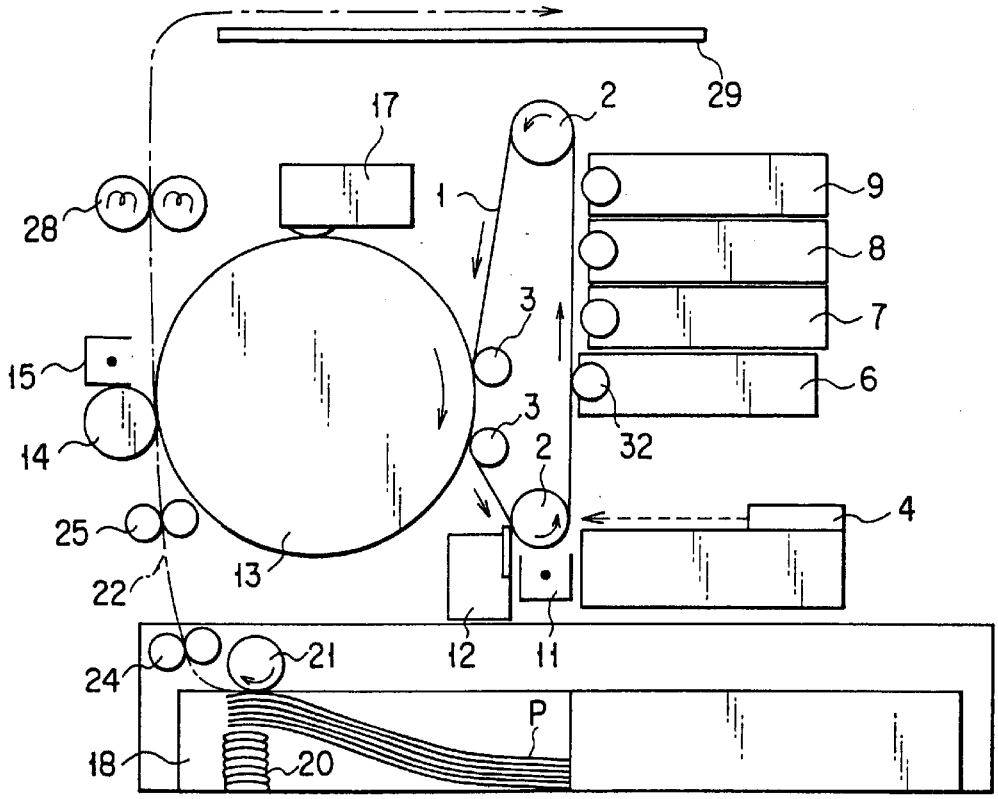
FIG. 1 is a schematic structural view of a color image forming apparatus according to the first embodiment of the present invention.

FIG. 1 is a schematic structural view of a color image forming apparatus according to the first embodiment of the present invention.

In FIG. 1, reference numeral 1 denotes a photosensitive belt serving as an image carrier. The photosensitive belt 1 is stretched in such a manner that it is wound around a plurality of rollers 2, 2 and 3 spaced at predetermined intervals. The photosensitive belt 1 is driven in the direction indicated by the arrow. An exposure unit 4 and a plurality of developing units 6-9 are arranged on one side of the photosensitive belt 1 in such a manner that they face the photosensitive belt 1. The developing units 6–9 are used for developing black, cyan, magenta and yellow colors.

Located under the photosensitive belt 1 are an electric charger 11 for electrically charging the surface of the photosensitive belt 1 and a belt cleaner 12 for removing residual toner from the photosensitive belt 1. On the other side of the photosensitive belt 1, an intermediate transfer drum 13 is located. The intermediate transfer drum 13 is in contact with the photosensitive belt 1 on one side thereof and rotatable in the direction indicated by the arrow. On the other side of the intermediate transfer drum 13, a transfer roller 14 and a separation charger 15 are arranged. In the region above the intermediate transfer drum 1, a drum cleaner 17 is arranged to remove residual toner from the intermediate transfer drum 1.

In the region under the intermediate transfer drum 13, a sheet feeding cassette 18 is located, and sheets P are contained in this sheet feeding cassette 18. The leading ends of the sheets P are pressed against a pickup roller 21 by means of a spring member 20. Sheets are taken out in accordance with the rotation of the pickup roller 21. After being taken out by the pickup roller 21, a sheet P is carried upward along a conveyance path 22. A pair of conveyance rollers 24, a pair of aligning rollers 25, the transfer roller 14 mentioned above, the separation charger 15 also mentioned above, a fixing unit 28 and a sheet discharge tray 29 are arranged in the conveyance path 22. These structural elements are sequentially arranged in the feeding direction of sheet P.

Figure 2:
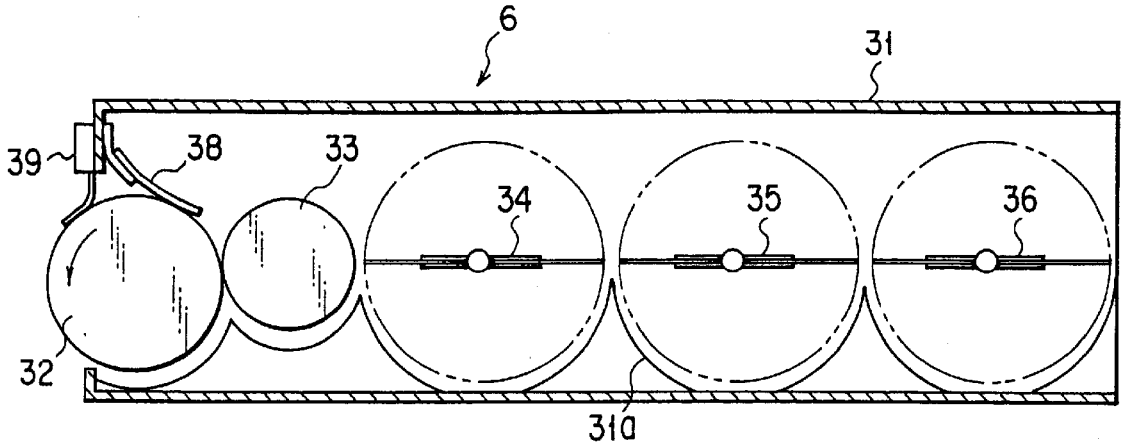
FIG. 2 is a longitudinal side view of a developing apparatus that is provided for the color image forming apparatus.

FIG. 2 is a structural view of a black-developing unit 6.

The black-developing unit 6 comprises a developing casing 31, and one-component nonmagnetic toner, which is commercially available as a developing agent, is contained in the developing casing 31. A developing roller 32 is arranged inside the developing casing 31. The developing roller 32 rotates at a peripheral speed of 300 mm/s and serves to supply toner to the photosensitive belt 1. A toner supply roller 33 for supplying toner to the developing roller 32 and a group of conveyance blades 34, 35 and 36 for conveying toner from behind the toner supply roller 33, are arranged inside the developing casing 31.

A layer regulation blade 38 adapted for regulating the thickness of a layer of toner supplied from the toner supply roller 33 and a thermistor 39 serving as a temperature sensing member for sensing the temperature of the surface of the developing roller 32, are provided for the upper front portion of the developing casing 31. The lower portions of the layer regulation blade 38 and thermistor 39 are in contact with the surface of the developing roller 32.

Figure 3:
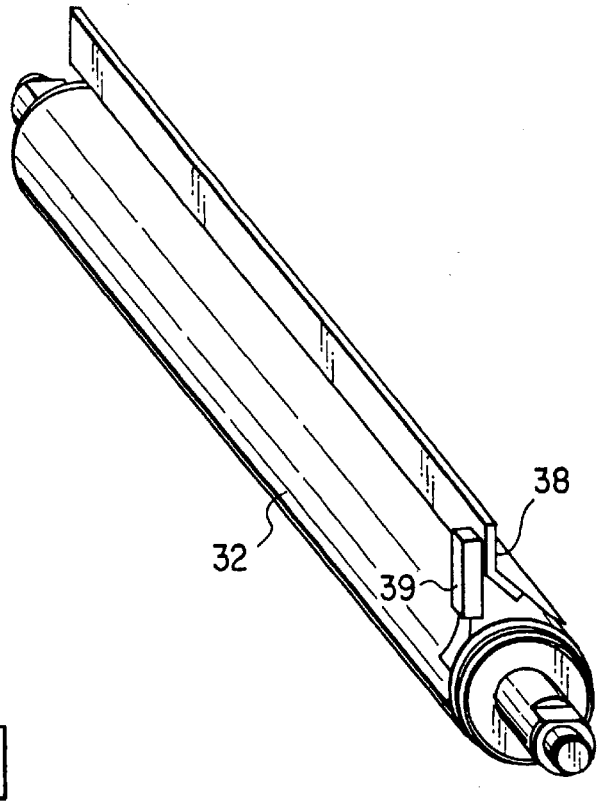
FIG. 3 is a perspective view showing a developing roller, a layer regulation member and a thermistor.

FIG. 3 is a perspective view showing the developing roller 32, the layer regulation blade 38 and the thermistor 39.

The developing roller 32 is a tubular member formed of aluminum, and its surface is subjected to sandblasting in such a manner that Rz is in the range of 2 to 3 $\mu$m and Ra is in the range of 0.3 to 0.4. The outer diameter of the tubular member is about $\phi$ 18.

The toner supply roller 33 is about $\phi$ 13.5 and formed of expanded polyurethane. The toner supply roller 33 is electrically conductive; it has a resistance of $10^3$ or thereabout.

The layer regulation blade 38 is a leaf spring formed of a stainless material and having a thickness of 0.1 mm. The force with which the layer regulation blade 38 is pressed against the developing roller 32 is 2.0 kgf. Each of the conveyance blades 34, 35 and 36 has Mylar sheets arranged at two positions (each sheet covering an angle of 180 degrees). The Mylar sheets brush against the curved surface 31*a* at the bottom of the developing casing 31, thereby causing the toner in the developing casing 31 to move toward the toner supply roller 33.

Figure 4:
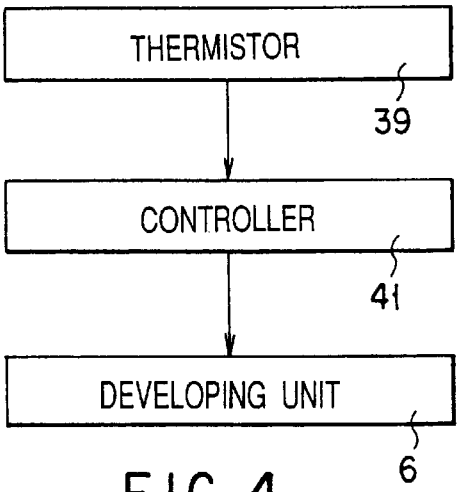
FIG. 4 is a block diagram showing the driving control system of a developing unit.

FIG. 4 is a block diagram showing the driving control system of the developing unit 6.

The thermistor 39 is connected to a controller 41, and the developing unit 6 is connected to that controller 41 through a control circuit. In accordance with the temperature sensed by the thermistor 39, the controller 41 controls the operation of the developing unit 6.

For example, when the thermistor 39 senses 40° C., the rotation of the developing roller 32 is stopped, thereby stopping the image formation executed by the image formation section. On the other hand, when the thermistor 39 senses 35° C., the developing roller 32 is rotated again, thereby resuming the image formation by the image formation section.

A description will now be given as to how an image forming operation is performed.

First, reference will be made to the case where color printing is effected.

In this case, the photosensitive belt 1 is driven, and the electric charger 11 uniformly charges the surface of the belt 1. On the surface of the electrically charged photosensitive belt 1, an electrostatic latent image is formed by controlling the exposure unit 4 to perform an exposure operation corresponding to a yellow image. The electrostatic latent image is carried to the yellow—developing unit 9 in accordance with the movement of the photosensitive belt 1. Yellow toner is supplied from the yellow developing unit 9, and the electrostatic latent image is turned into a yellow image. This yellow image is carried to the intermediate transfer drum 13 in accordance with the movement of the photosensitive belt 1 and is transferred onto the intermediate transfer drum 13. After this transfer, the photosensitive belt 1 separates from the intermediate transfer drum 13 and is optically discharged by an electrical discharger (not shown). Then, the toner which is not transferred to the intermediate transfer drum 13 and thus remains on the photosensitive belt 1 is cleaned away by the belt cleaner 12. The toner obtained by this cleaning operation is collected in a waste toner box.

Thereafter, the electric charger 11 charges the photosensitive belt 1 again, and the exposure unit 4 performs exposure in accordance with a magenta image, thereby forming an electrostatic latent image. The electrostatic latent image is carried to the magenta-developing unit 8 in accordance with the movement of the photosensitive belt 1. Magenta toner is supplied from the magenta-developing unit 8, and the electrostatic latent image is turned into a magenta image. This magenta image is carried to the intermediate transfer drum 13 in accordance with the movement of the photosensitive belt 1, and is transferred onto the intermediate transfer drum 13 in such a manner that the magenta image is superimposed on the yellow image. Thereafter, a cyan image and a black image are formed and transferred on the intermediate transfer drum 13, whereby four-color toner images are superimposed on the intermediate transfer drum 13.

In the meantime, the pickup roller 21 is rotated to take out a sheet P. This sheet P passes through the region between the intermediate transfer drum 13 and the transfer roller 14, and the superimposed four toner images are transferred from the intermediate transfer drum 13 onto a sheet P (secondary transfer). The sheet P bearing the transferred images is separated from the intermediate transfer drum 13 by the separation charger 15. The separated sheet P is supplied to the fixing unit 28, by which the color images are fixed onto the sheet P. Subsequently, the sheet P is discharged onto the sheet discharge tray 29.

After the secondary discharge described above, part of the toner remains on the intermediate transfer drum 13. The remaining toner is removed and cleaned away by the drum cleaner 17.

The drum cleaner 17 is kept away from the intermediate transfer drum 13 when the four-color images described above are being formed.

In the case of black-and-white monochromatic printing, the photosensitive belt 1 is driven in the manner described above, and the electric charger 11 uniformly charges the surface of the belt 1. On the electrically charged surface of the photosensitive belt 1, the exposure unit 4 performs exposure in accordance with a black image, thereby forming an electrostatic latent image. The electrostatic latent image is carried to the black-developing unit 6 in accordance with the movement of the photosensitive belt 1. Black toner is supplied from the black-developing unit 6, and the electrostatic latent image is turned into a black image. This black toner image is carried to the intermediate transfer drum 13 in accordance with the movement of the photosensitive belt 1, and is transferred onto the intermediate transfer drum 13.

In the meantime, the rotating pickup roller 21 takes out a sheet P. This sheet P passes through the region between the intermediate transfer drum 13 and the transfer roller 14, and the black image is transferred from the intermediate transfer drum 13 onto the sheet P. After this transfer, the sheet P is supplied to the fixing unit 28, by which the black image is fixed onto the sheet P. After this fixing operation, the sheet P is discharged onto the sheet discharge tray 29.

In the case where color printing is executed in succession, the developing roller of one developing unit can be stopped and kept in a stationary state when the other three developing units are executing a developing operation.

Assuming that the developing time of one color is t, each developing roller is rotated for a time length of t and is then kept in the stationary state for a time length of (t×3).

Hence, the degradation of the image quality, which is due to the adhesion of toner to the layer regulation blade 38, does not occur in the present invention.

For successive execution of black-and-white monochromatic printing, images corresponding to black toner images have to be successively formed on the photosensitive belt 1. This means that the developing roller 32 of the black-developing unit 6 is kept rotated successively and without being halted for a long time. Due to this successive rotation, the developing roller 32 and the layer regulation blade 38 increase in temperature. A short time after the temperature of the developing roller 32 exceeds 40° C., a longitudinal stripe may be formed in the toner layer on the developing roller 32. If this happens, no toner layer is formed along the stripe. This phenomenon was examined by dismantling the related structural components, and it was confirmed that toner adheres to the surface of the layer regulation blade 38 at positions corresponding to the longitudinal stripe.

According to the present invention, the thermistor 39 detects the temperature of the developing roller 32 before an image is printed on a sheet of paper, and the printing operation is controlled in accordance with the detected temperature.

The temperature information obtained by the thermistor 39 is supplied to the controller 41. If the temperature information indicates a temperature higher than a predetermined temperature (40° C. in the case of this embodiment), the controller 41 determines that the next printing operation should not be executed. When the temperature detected by the thermistor 39 becomes lower than a predetermined temperature (35° C. in the case of this embodiment), the controller 41 determines that the printing operation should be resumed.

By this control of the printing operation, images with improved quality could be made even after black-and-white monochromatic printing was executed successively.

The temperature control and the rest time in printing operation are not necessarily limited to the above values, since they are dependent on the type of toner employed, the pressure exerted by the layer regulation blade 38 and the peripheral speed of the developing roller 32. An optimal temperature and an optimal rest time have to be determined in accordance with various conditions.

Figure 5:
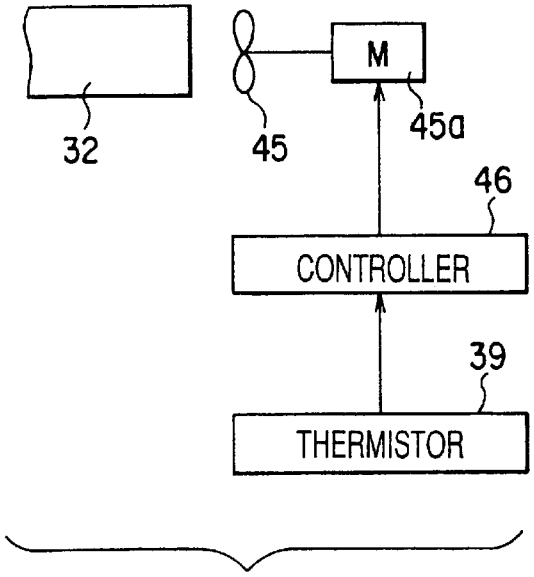
FIG. 5 is a structural diagram showing a developing apparatus according to the second embodiment of the present invention.

FIG. 5 shows a second embodiment of the present invention. According to the second embodiment, a small-sized cooling fan 45, serving as a cooling means, is provided on one side of a developing roller 32. A thermistor 39, which detects the temperature of a developing roller 32, is connected through a signal processing circuit to a controller 46. To this controller 46, the driving motor 45*a* of the cooling fan 45 is connected via a control circuit.

The cooling fan 45 is commercially available from "Oriental Motor." It is shaped like a square with 50 mm sides, has a thickness of 10 mm, and has a maximal blowing power of 0.27 $m^3$/min. The cooling fan 45 blows air to the side of the developing unit 6.

According to the second embodiment, the thermistor 39 senses the temperature of the developing roller 32 during image formation, and the sensing information is supplied to the controller 46. When the thermistor 39 senses a temperature of 40° C. or higher, the controller 46 rotates the cooling fan 45 and blows air to the developing roller 32 to cool the same. When the temperature of the developing roller 32 has lowered to 35° C., the cooling fan 45 is stopped. Thereafter, the rotation and stopping of the cooling fan 45 are repeated in a similar manner.

Owing to this feature, toner does not adhere to the layer regulation blade 38, as in the prior art, and images of excellent quality are ensured even in the case of successive printing.

Figure 6:
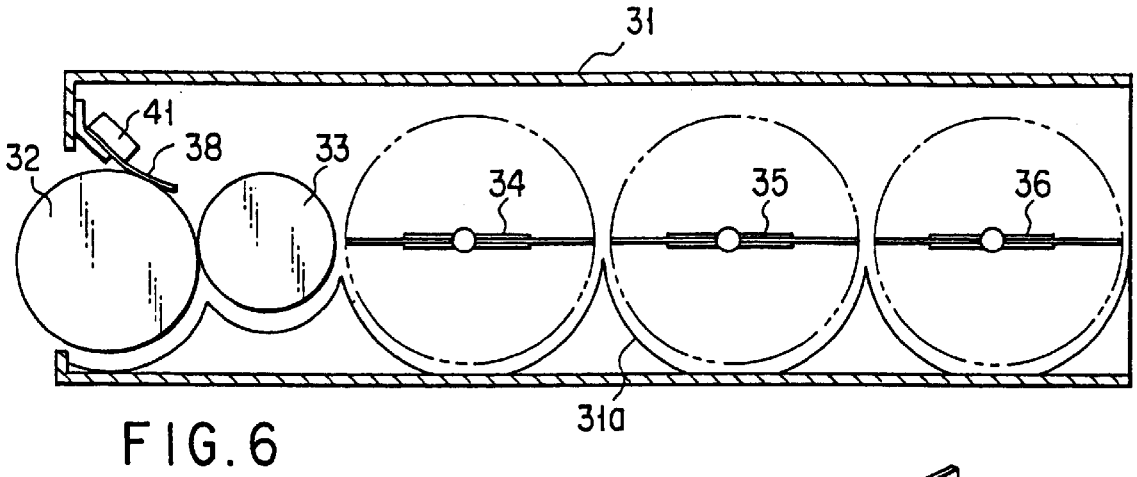
FIG. 6 is a longitudinal side view of a developing apparatus according to the third embodiment of the present invention.
Figure 7:
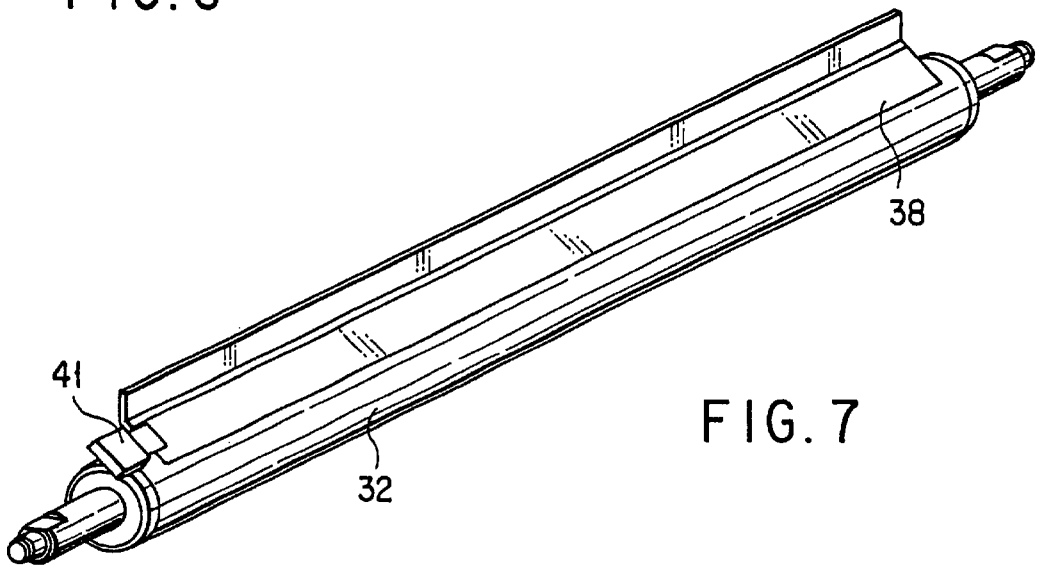
FIG. 7 is a perspective view showing a developing roller, a layer regulation member and a thermistor.

FIGS. 6 and 7 show the third embodiment of the present invention.

According to the third embodiment, a thermistor 41 is attached to a layer regulation blade 38 to sense its temperature.

Like the first embodiment, the third embodiment stops the developing unit 6 when the thermistor 41 senses a temperature higher than 40° C. The developing unit 6 is driven again when the thermistor 41 senses a temperature of 35° C.

The advantages of the third embodiment are similar to those of the foregoing embodiments.

Figure 8:
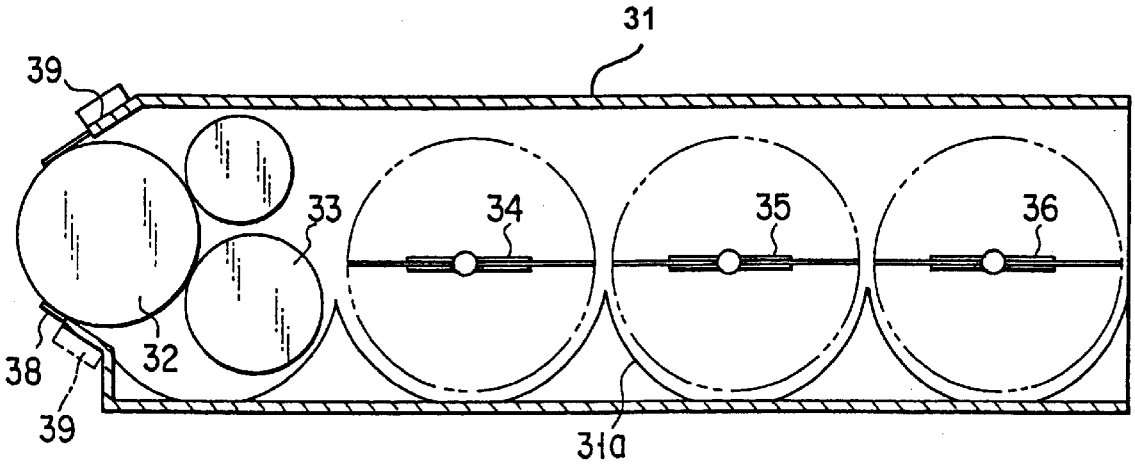
FIG. 8 is a longitudinal side view of a developing apparatus according to the fourth embodiment of the present invention.

FIG. 8 shows a fourth embodiment of the present invention.

According to the fourth embodiment, a layer regulation blade 38 is located outside of a developing casing 31 and is in contact with the lower portion of a developing roller 32 in such a manner that it is arranged along the rotating direction of the developing roller 32.

According to the fourth embodiment, the contact surface between the developing roller 32 and the layer regulation blade 38 is exposed outside of the developing casing 31. Since the contact surface, which becomes hottest among other things, is exposed, the air-cooling effect by the cooling fan 45 described in relation to the second embodiment is noticeable. It should be also noted that the thermistor 39 may be provided for the layer regulation blade 38.

Figure 9:
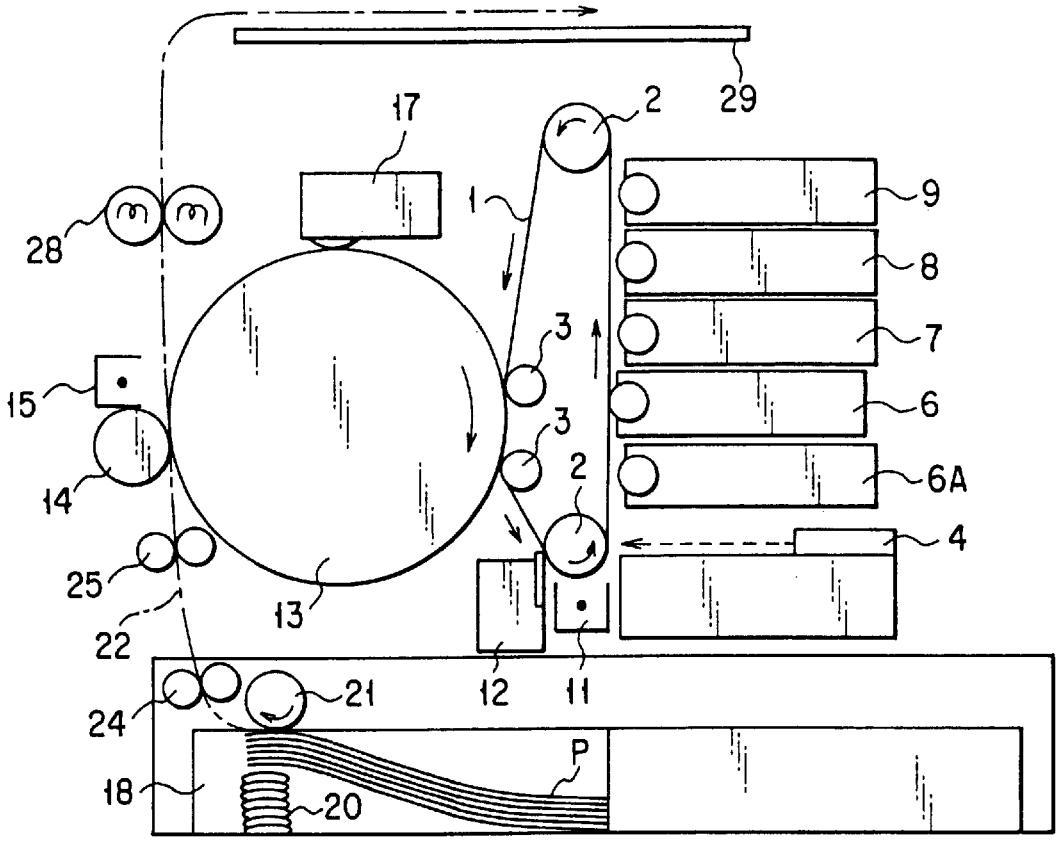
FIG. 9 is a schematic structural view of a color image forming apparatus according to the fifth embodiment of the present invention.

FIG. 9 shows a color image forming apparatus according to the fifth embodiment of the present invention. In FIG. 9, the same references as used in relation to the first embodiment denote similar or corresponding structural elements.

According to the fifth embodiment, a second black-developing unit 6A is added to the color image forming apparatus shown in FIG. 1.

The second black-developing unit 6A is similar in structure to the black-developing unit 6 (hereinafter referred to as "first black-developing unit"). The second black-developing unit 6A is provided with a second thermistor 51 (FIG. 10) for sensing the temperature of the developing roller 32. The first and second black-developing units 6 and 6A are movable closer to or away from the photosensitive belt 1 and are selectively used.

Figure 10:
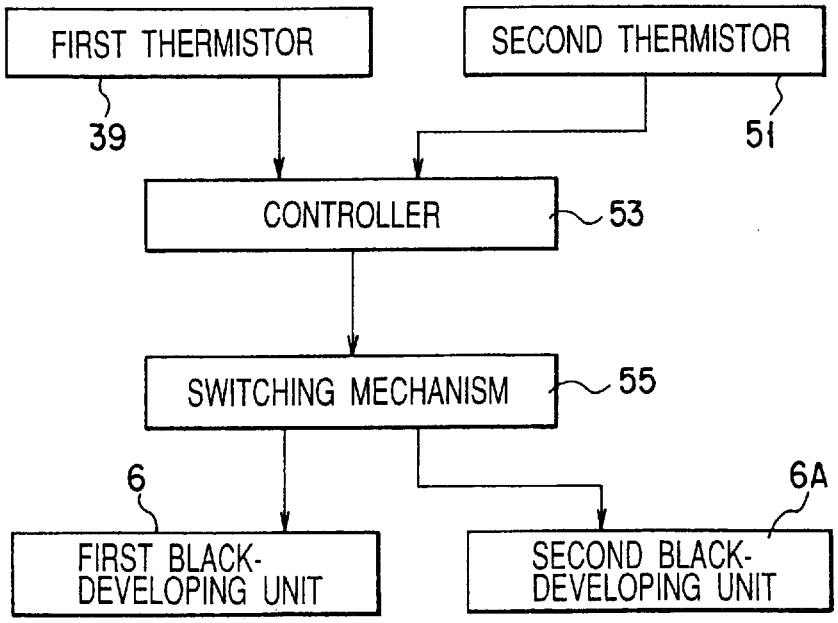
FIG. 10 is a block diagram showing the driving control system of a developing unit.

FIG. 10 is a black diagram showing the driving control system of a switching mechanism 55, which switches over between the first and second black-developing units 6 and 6A.

The first and second thermistors 39 and 51 are connected to a controller 53 through a signal circuit. A switching mechanism 55 is connected to the controller 53 through a control circuit. The switching mechanism 55 selects one of the first and second black-developing units 6 and 6A for use.

When black-and-white monochromatic printing is executed, black toner images are successively formed on a photosensitive belt 1, and the developing roller 32 of the first developing unit 6 is not halted for a long time but kept rotating continuously. As a result, the developing roller 32 and the layer regulation blade 38 increase in temperature. If the temperature of the first thermistor 39 becomes higher than 40° C., toner will adhere to the layer regulation blade 38, resulting in a longitudinal stripe on an image to be produced.

To solve this problem, the fifth embodiment successively prints black-and-white monochromatic images as follows. When the temperature of the thermistor 39 of the first black-developing unit 6 exceeds 40° C., the controller 53 actuates the switching mechanism 55 when the printing operation for the next sheet of paper is started. The switching mechanism 55 separates the first black-developing unit 6 from the photosensitive belt 1 and stops the rotation of the developing roller 32. Then, the second black-developing unit 6A, which has been at rest until then, is moved toward the photosensitive belt 1, and the developing roller 32 is rotated and brought into contact with the photosensitive belt 1, thereby starting the next printing operation.

In the subsequent operation, the first and second black-developing units 6 and 6A are alternately used in the manner described above. This enables black-and-white monochromatic printing without giving rise to defective images.

As described above, according to the present invention, the temperature of either the developing roller 32 or the layer regulation blade 38 is sensed. When the temperature of the developing roller 32 becomes equal to a predetermined temperature, the developing roller 32 is stopped and cooled, and the other developing unit is used in place of it. By taking this procedure, a developing agent is prevented from adhering to the layer regulation blade, and reliable image production is ensured for a long period of time.

Needless to say, the present invention is not limited to the above embodiments and may be modified in various manners departing from the spirit and scope of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing apparatus comprising:

a developing roller for supplying a developing agent to an image carrier by rotation;

a layer regulation member for regulating a layer thickness of the developing agent supplied to the developing roller;

temperature sensing means for sensing a temperature of either the developing roller or the layer regulation member; and control means for controlling the rotation of the developing roller in accordance with a temperature sensed by the temperature sensing means.

2. A developing apparatus according to claim 1, wherein said developing agent is one-component nonmagnetic toner.

3. A developing apparatus according to claim 1, wherein said temperature sensing means is a thermistor.

4. A developing apparatus comprising:

a developing roller for supplying a developing agent to an image carrier by rotation;

a layer regulation member for regulating a layer thickness of the developing agent supplied to the developing roller;

temperature sensing means for sensing a temperature of either the developing roller or the layer regulation member;

cooling means for cooling the developing roller by supplying air to the developing roller; and control means for controlling air supply by the cooling means in accordance with a temperature sensed by the temperature sensing means.

5. A developing apparatus according to claim 4, wherein said developing agent is one-component nonmagnetic toner.

6. A developing apparatus according to claim 4, wherein said temperature sensing means is a thermistor.

7. A developing apparatus comprising:

first and second developing means which are selectively used and each of which includes: a developing roller for supplying a developing agent to an image carrier by rotation; a layer regulation member for regulating a layer thickness of the developing agent supplied to the developing roller; and temperature sensing means for sensing a temperature of either the developing roller or the layer regulation member; and switching means, operating when one of the first and second developing means is in use, for switching the developing means in use to another developing means in accordance with a temperature sensed by the temperature sensing means.

8. A developing apparatus according to claim 7, wherein said developing agent is one-component nonmagnetic toner.

9. A developing apparatus according to claim 7, wherein said temperature sensing means is a thermistor.

10. A developing apparatus comprising:

a developing roller to supply a developing agent to an image carrier by rotation;

a layer regulation blade to regulate a layer thickness of the developing agent supplied to the developing roller;

a thermistor to sense a temperature of either the developing roller or the layer regulation blade; and a controller to control the rotation of the developing roller in accordance with the temperature sensed by the thermistor.

11. The developing apparatus according to claim 10, wherein the developing agent is a one-component nonmagnetic toner.

12. The developing apparatus according to claim 10, wherein the thermistor contacts a surface of either the developing roller or the layer regulation blade.

13. The developing apparatus according to claim 10, wherein the controller stops rotation of the developing roller when the temperature rises to 40° C. or higher.

14. The developing apparatus according to claim 13, wherein the controller restarts rotation of the developing roller when the temperature drops from 40° C. or higher to 35° C.

15. An image forming apparatus comprising:

an image carrier;

a developing roller to supply a developing agent to the image carrier by rotation;

a layer regulation blade to regulate a layer thickness of the developing agent supplied to the developing roller;

a thermistor to sense a temperature of either the developing roller or the layer regulation blade;

a cooling fan to cool the developing roller by supplying air to the developing roller; and a controller to control air supply by the cooling fan in accordance with the temperature sensed by the thermistor.

16. The image forming apparatus according to claim 15, wherein the developing agent is a one-component nonmagnetic toner.

17. The image forming apparatus according to claim 15, wherein the thermistor contacts a surface of either the developing roller or the layer regulation blade.

18. The image forming apparatus according to claim 15, wherein the controller stops rotation of the developing roller when the temperature rises to 40° C. or higher.

19. The image forming apparatus according to claim 18, wherein the controller restarts rotation of the developing roller when the temperature drops from 40° C. or higher to 35° C.

20. The image forming apparatus according to claim 15, wherein the developing agent is only of a black color.

21. An image forming apparatus comprising:

an image carrier;

a first developing device and a second developing device which are selectively used and each of which includes:

a developing roller to supply a developing agent to the image carrier by rotation;

a layer regulation blade to regulate a layer thickness of the developing agent supplied to the developing roller;

a thermistor to sense a temperature of either the developing roller or the layer regulation blade; and a switch, operating when one of the first developing device and second developing device is in use, to switch one of the first developing device and second developing device in use to another of the first developing device and second developing device in accordance with the temperature sensed by the thermistor.

22. The image forming apparatus according to claim 21, wherein the developing agent is a one-component nonmagnetic toner.

23. The image forming apparatus according to claim 21, wherein the thermistor contacts a surface of either the developing roller or the layer regulation blade.

24. The image forming apparatus according to claim 21, wherein the controller stops rotation of the developing roller when the temperature rises to 40° C. or higher.

25. The image forming apparatus according to claim 24, wherein the controller restarts rotation of the developing roller when the temperature drops from 40° C. or higher to 35° C.

26. An image forming apparatus according to claim 21, wherein the developing agent is only of a black color.

27. A color image forming apparatus comprising:

an image carrier;

a first developing device and a second developing device which are selectively used and each of which includes:

a developing roller to supply a developing agent to the image carrier by rotation;

a layer regulation blade to regulate a layer thickness of the developing agent supplied to the developing roller;

a thermistor to sense a temperature of either the developing roller or the layer regulation blade; and a switch, operating when one of the first developing device and second developing device is in use, to switch one of the first developing device and second developing device in use to another of the first developing device and second developing device in accordance with the temperature sensed by the thermistor.

28. The image forming apparatus according to claim 27, wherein the developing agent is of a black color.

* * * * *